US007271686B2

(12) United States Patent
Yoshikawa et al.

(10) Patent No.: US 7,271,686 B2
(45) Date of Patent: Sep. 18, 2007

(54) DIELECTRIC FILTER AND WIRELESS COMMUNICATION SYSTEM

(75) Inventors: Hiromichi Yoshikawa, Kokubu (JP); Akira Nakayama, Kagoshima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/987,588

(22) Filed: Nov. 12, 2004

(65) Prior Publication Data

US 2005/0122192 A1 Jun. 9, 2005

(30) Foreign Application Priority Data

Nov. 13, 2003 (JP) ..... 2003-383952
Sep. 29, 2004 (JP) ..... 2004-284151

(51) Int. Cl.
*H01P 1/20* (2006.01)
*H01P 7/10* (2006.01)

(52) U.S. Cl. ..... 333/202; 333/239

(58) Field of Classification Search ..... 333/202, 333/208, 219, 239, 219.1, 34
See application file for complete search history.

(56) References Cited

U.S. PATENT DOCUMENTS 5,945,894 A * 8/1999 Ishikawa et al. ..... 333/202
5,986,527 A * 11/1999 Ishikawa et al. ..... 333/239
6,236,291 B1 5/2001 Sonoda et al.
6,445,263 B1 * 9/2002 Sonoda et al. ..... 333/134
6,538,526 B2 * 3/2003 Mikami et al. ..... 333/24 R
6,927,653 B2 * 8/2005 Uchimura et al. ..... 333/208

FOREIGN PATENT DOCUMENTS

JP 08-265015 10/1996
JP 10-303618 11/1998

OTHER PUBLICATIONS

Chinese Language Office Action and Its English Translation for Chinese Application No. 200410092708.0 lists the reference above.

* cited by examiner

*Primary Examiner*—Seungsook Ham
(74) *Attorney, Agent, or Firm*—Hogan & Hartson LLP

(57) ABSTRACT

A dielectric resonator is arranged such that an upper electrode 4*a* and a lower electrode 4*b* are disposed on both surfaces of a dielectric substrate 1 that has an interior metallized layer inside thereof, which is formed with a resonance aperture area 3. A dielectric filter is produced by arranging a plurality of rows of the dielectric resonators, and using a multilayer-type waveguide 6 formed by lines of via conductors for signal input and output. This dielectric filter allows the accuracy for designing resonant frequencies to be greatly improved and the production process to be simplified.

9 Claims, 15 Drawing Sheets

DIELECTRIC FILTER AND WIRELESS COMMUNICATION SYSTEM

BACKGROUND OF THE INVENTION

1. Field of the Invention

The present invention relates to a dielectric resonator, a dielectric filter and a wireless communication system using the dielectric filter.

2. Description of the Related Art

In recent years, communication systems for millimeter wave bands such as wireless LAN have been studied, and at the same time, passive devices used for such systems have been eagerly studied.

As a conventional multilayer-type dielectric resonator used for millimeter wave bands, a dielectric resonator having a rectangular multilayer waveguide structure as shown in FIGS. 18(*a*) and 18(*b*) has been proposed. This dielectric resonator comprises a dielectric substrate 1 including a plurality of stacked dielectric layers, a lower conductor 4*b* and an upper conductor 4*a* disposed to be in contact with the dielectric substrate 1, a conductor 2 disposed in a layer inside the dielectric substrate 1 which has a rectangular resonance aperture area 3, and via conductors 5 connecting the lower conductor 4*b* to the upper conductor 4*a*. The via conductors 5 enclose the resonance aperture areas 3 thereby to constitute the dielectric resonator. The resonance mode is $TE_{10}$ mode in which an electric field perpendicular to the lower and upper conductors 4*b* and 4*a* is generated. In this structure, size reduction is achieved as compared to conventional waveguide structures.

It is possible to compose a multilayer-type dielectric filter with input/output sections by connecting input and output terminals of the dielectric resonator to the dielectric resonator by means of irises of the via conductors. In addition, it is also possible to accomplish coupling of dielectric resonators by connecting a plurality of dielectric resonators having the same structure to one another by means of irises of the via conductors.

There is also proposed a $TE_{010}$ mode dielectric resonator as a dielectric resonator of a type that has a space utilized for millimeter wave bands. As shown in FIG. 19, this dielectric resonator includes a dielectric substrate 1 in a central area of a space surrounded by metal conductors 4*a* and 4*b*. Conductor plates 2*a* and 2*b* are disposed on and under the dielectric substrate 1 to be in contact with the dielectric substrate 1, and the conductor plates 2*a* and 2*b* are provided with circular resonance aperture areas 3*a* and 3*b*, respectively, so that a part of the dielectric is exposed. This dielectric resonator is utilized for filters for millimeter wave bands.

Meanwhile, challenges in passive devices for millimeter wave bands are miniaturization and cost reduction. When technologies used in mass production of applications for microwave bands are applied to those for millimeter wave bands, due to the small sizes of the parts, the machining accuracy fails to respond to the small sizes. This results in an increase in unit price of the parts.

To take the case of the multilayer dielectric resonator used for millimeter wave bands (FIG. 18), if misalignment occurs in the arrangement of the via conductors 5, the resonant frequency may deviate from the designed value. The variation in resonance frequency represents the difference between the design value of the dielectric filter and that after the production of the same. For this reason, it is necessary to arrange a great number of via conductors in the dielectric resonator with high accuracy. Therefore, producing dielectric resonators with high yield is difficult without adjustments, leading to high costs.

Also, in the case of the aforesaid dielectric resonator with a space (FIG. 19), if misalignment of the axes of the resonance apertures 3*a* and 3*b* occurs, the resonant frequency may deviate from the designed value. This variation in resonant frequency represents the difference between the design value of the dielectric filter and that after the production of the same. It is predicted that as the size of the resonance apertures becomes smaller, the deviation of the resonant frequency from the design value associated with misalignment of the axes of the upper and lower resonance aperture areas increases.

It is an object of the present invention to provide a dielectric resonator, a dielectric filter and a wireless communication system using the dielectric filter that allow the accuracy for designing resonant frequencies to be greatly improved.

It is another object of the present invention to provide a dielectric resonator, a dielectric filter and a wireless communication system using the dielectric filter that allow the production process to be simplified and the cost to be reduced.

BRIEF SUMMARY OF THE INVENTION

The present inventors have composed a dielectric resonator that is arranged such that a resonance aperture area is formed in a conductor layer inside a dielectric substrate that is disposed between a lower conductor and an upper conductor.

This dielectric resonator allows a resonance space to be formed by one interior conductor layer and upper and lower conductors without using via conductors. Since the resonance aperture area in the interior conductor layer can be formed with high precision by using techniques such as printing and the like, the resonant frequency can be accurately designed, and also improvement in machining accuracy can be expected. By incorporating the dielectric resonator into a multilayer wiring board and a semiconductor package, cost reduction, miniaturization, high performance can be expected particularly in applications for millimeter wave bands.

The geometry of the resonance aperture area may be circular. When it is circular, $TE_{011}$ mode in which the electric field travels circumferentially can be easily employed as the resonance mode.

A dielectric filter according to the present invention comprises a plurality of resonance aperture areas formed in the interior conductor layer of the foregoing dielectric resonator, and a multilayer-type waveguide formed by lines of via conductors. The resonance aperture areas are juxtaposed with a predetermined distance in between, and open end portions of the multilayer-type waveguide are opposed to one of the plurality of resonance aperture areas in the interior conductor layer. Signal input or signal output is effected by the multilayer-type waveguide.

With this arrangement, since the dielectric resonators are formed to be juxtaposed in a lateral direction, a dielectric filter with a small height can be produced. In addition, because of the use of the multilayer-type waveguide formed by rows of via conductors, miniaturization can be achieved.

The geometry of the resonance aperture areas may be circular. When they are circular, $TE_{011}$ mode in which the electric field travels circumferentially can be easily employed as the resonance mode.

When the lines of via conductors are arranged so that an opening diameter thereof increases as they near the resonance aperture areas to form a funnel-like or horn-like configuration, the electromagnetic coupling between the multilayer-type waveguide and the resonance section of the dielectric filter can be strengthened.

When the lines of via conductors are arranged so that an opening diameter thereof starts to increase from a location in the vicinity of the resonance aperture areas to form a stepped configuration, the electromagnetic coupling between the multilayer-type waveguide and the resonance section of the dielectric filter can also be strengthened.

When the dielectric filter is arranged such that the resonance aperture areas in the interior conductor layer and open end portions of the multilayer-type waveguide are spaced apart by a predetermined distance by the interior conductor layer, the resonance aperture areas of the interior conductor layer can secure an enclosed space on the interior conductor layer. As a result, the Q factor of the resonators can be prevented from decreasing.

In addition, when the dielectric filter is arranged such that the resonance aperture areas in the interior conductor layer and open end portions of the multilayer-type waveguide are directly communicated with each other, coupling between the multilayer-type waveguide and the resonance section formed by the resonance aperture areas of the interior conductor layer can be strengthened.

According to the present invention, a dielectric filter is produced by simultaneously and integrally firing a plurality of the foregoing dielectric layers formed with via holes for forming the rows of via conductors, the lower conductor, the upper conductor, and the interior conductor layer having the plurality of resonance aperture areas. This enables inexpensive dielectric filters to be produced through a simple production process.

Moreover, the present invention can provide wireless communication systems such as millimeter wave radars, wireless LANs, hot spot and ad hoc wireless systems and the like at low cost and with reduced sizes and excellent performance by incorporating the foregoing dielectric filter into a wireless communication system.

Furthermore, the present inventors have further composed a dielectric resonator arranged such that a dielectric substrate is disposed on a lower conductor, an intermediate conductor layer is formed on the dielectric substrate, a resonance aperture area is formed in the intermediate conductor layer, and an upper conductor is disposed being separated from the intermediate conductor layer by a space.

That is, a dielectric resonator according to the present invention comprises a planar-shaped lower conductor; a dielectric substrate disposed on the lower conductor being in contact therewith; an intermediate conductor disposed on the dielectric substrate being in contact therewith; and an upper conductor, wherein the intermediate conductor and the upper conductor are spaced apart from each other by support members to form a space in between, and the intermediate conductor has a resonance aperture area formed therein, and the dielectric substrate is exposed to the space through the resonance aperture area.

With this structure, since the structure is simplified so that it is unnecessary to consider misalignment of axes at the resonance aperture area as compared to conventional $TE_{010}$ mode dielectric resonators, the production of dielectric resonators becomes easier than the production of conventional ones. Low cost, miniaturization and high performance can be expected particularly for resonators for millimeter wave bands by the use of this dielectric resonator.

The foregoing resonance aperture area maybe of circular shape.

It is preferred that in the foregoing dielectric resonator, the support members are tube-like conductors, for example, cylindrical conductors whose bottom surfaces are formed by the upper conductor, and open ends of the tube-like conductors are arranged to be in contact with the intermediate conductor including the resonance aperture area. With this structure, millimeter waves can be enclosed in the foregoing space at the frequency for use so that resonance can be accomplished.

In addition, it is preferred that the dielectric substrate of the foregoing dielectric resonator has a thickness and a relative dielectric constant that attenuate propagation of millimeter wave frequency signals at the resonant frequency. With this structure, it is possible to prevent electromagnetic waves from propagating in a lateral direction between the upper and lower conductors, in other words, to cause the propagation mode to be in the cutoff range. Accordingly, millimeter waves are prevented from spreading laterally, and as a result, resonance can be accomplished with millimeter waves enclosed.

Additionally, a dielectric filter according to the present invention comprises a planar-shaped lower conductor; a dielectric substrate disposed on the lower conductor being in contact therewith; an intermediate conductor disposed on the dielectric substrate being in contact therewith; an upper conductor; an input electrode for inputting millimeter wave frequency signals; and an output electrode for outputting millimeter wave frequency signals, wherein the intermediate conductor and the upper conductor are spaced apart from each other by support members to form a space in between, the intermediate conductor has a plurality of resonance aperture areas formed therein, and the dielectric substrate is exposed to the space through the resonance aperture areas.

This structure is characterized in that a plurality of dielectric resonators are formed to be juxtaposed in a lateral direction, and an input electrode for inputting millimeter wave frequency signals and an output electrode for outputting millimeter wave frequency signals are provided. With this structure, since the dielectric resonators are formed to be juxtaposed in a lateral direction, a dielectric filter with a height about one half that of the conventional ones can be produced.

The foregoing resonance aperture areas may be of circular shape.

When the support members supporting the intermediate conductor and the upper conductor are tube-like conductors and an open end of the tube-like conductors is arranged to be in contact with the intermediate conductor including the resonance aperture areas, the periphery of the dielectric filter is shielded with conductors, easily enabling enclosure of millimeter waves.

The foregoing tube-like conductors may be cylindrical conductors.

A coplanar line, strip line, microstrip line, multilayer-type waveguide, waveguide or nonradiative line may be used for one or both of the foregoing input electrode and the output electrode. With this structure, millimeter waves can be enclosed in the foregoing space at the operating frequency so that resonance can be accomplished.

By incorporating the foregoing dielectric filter into a wireless communication system, wireless communication systems such as millimeter wave radars, wireless LANs, hot spot and ad hoc wireless systems and the like can be provided at low cost and with reduced sizes and excellent performance.

Furthermore, a dielectric filter according to the present invention comprises: a planar-shaped lower conductor; a planar-shaped upper conductor; a first dielectric substrate disposed on the lower conductor being in contact therewith; a first intermediate conductor disposed on the first dielectric substrate being in contact therewith; a second dielectric substrate disposed under the upper conductor being in contact therewith; and a second intermediate conductor disposed under the second dielectric substrate being in contact therewith; an input electrode for inputting millimeter wave frequency signals; and an output electrode for outputting millimeter wave frequency signals, wherein the first intermediate conductor and the second intermediate conductor are spaced apart from each other by support members to form a space in between, the first and second intermediate conductors each have a plurality of resonance aperture areas formed therein, and the first and second dielectric substrates are exposed to the space through the resonance aperture areas.

This dielectric filter has a structure in which dielectric resonators are arranged in a vertical direction, so that the lateral width of the dielectric filter can be minimized.

The foregoing resonance aperture areas may be of circular shape.

When the support members are tube-like conductors and open ends on both sides of the tube-like conductors are arranged to be in contact with the first and second intermediate conductors including the resonance aperture areas, the periphery of the dielectric filter is shielded with conductors, easily enabling enclosure of millimeter waves.

The foregoing tube-like conductors may be cylindrical conductors.

A coplanar line, strip line, microstrip line, multilayer-type waveguide, waveguide or nonradiative line may be used for one or both of the foregoing input electrode and the output electrode.

By incorporating the foregoing dielectric filter into a wireless communication system, wireless communication systems such as millimeter wave radars, wireless LANs, hot spot and ad hoc wireless systems and the like can be provided at low cost with reduced sizes and excellent performance.

BRIEF DESCRIPTION OF THE DRAWINGS

FIG. 11(*b*) is a perspective view of the dielectric filter of FIG. 11(*a*).

FIG. 14(*b*) is a cross-sectional plan view showing the structure of the dielectric band-pass filter according to the present invention that is used in the simulation.

FIG. 18(*b*) is a vertical cross-sectional view of the structure of the conventional $TE_{10}$ mode dielectric resonator.

DETAILED DESCRIPTION OF THE INVENTION

Hereinafter, specific embodiments of the present invention will be described in detail with reference to the appended drawings.

Figure 1:
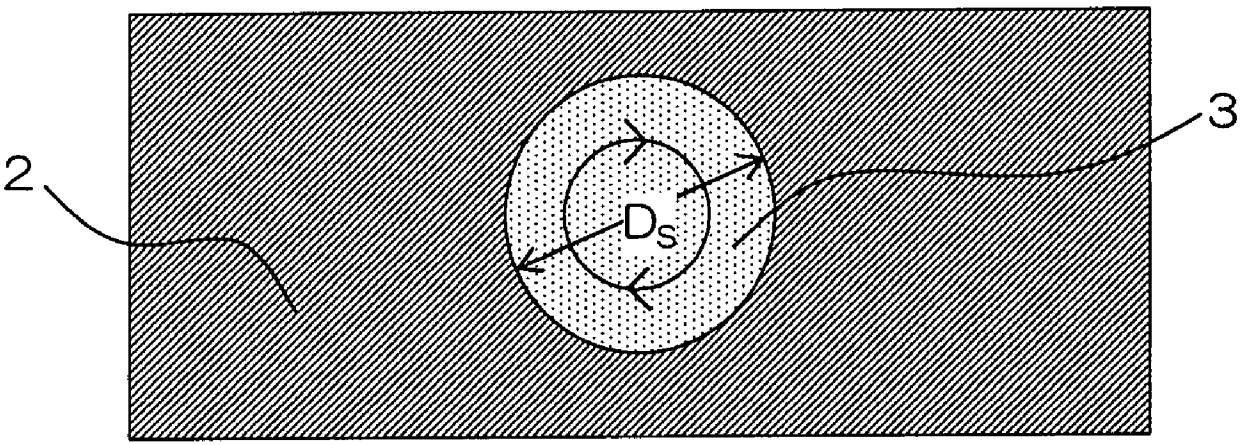
FIGS. 1(*a*) and 1(*b*) are a cross-sectional plan view and a vertical cross-sectional view, respectively, of a structural embodiment of a $TE_{011}$ mode dielectric resonator according to the present invention.
Figure 1:
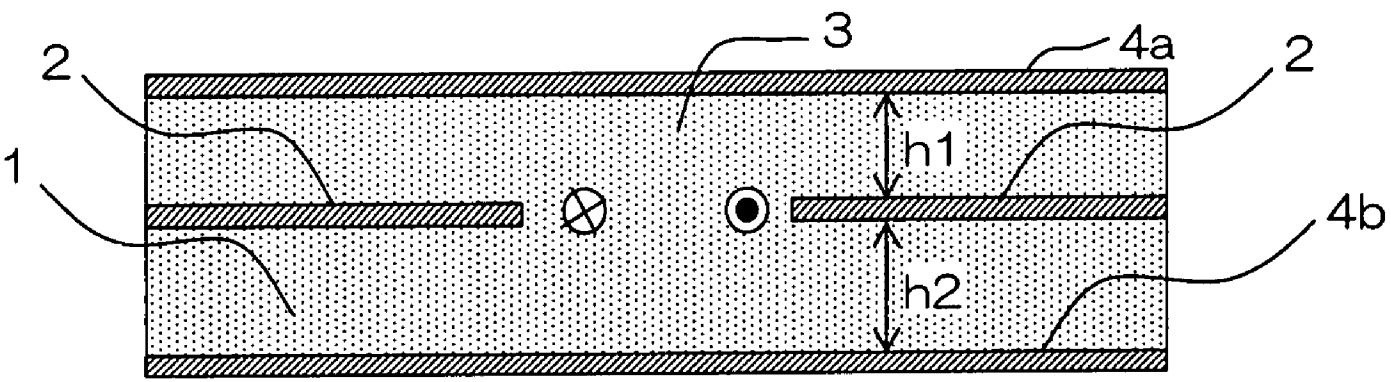

FIGS. 1(*a*) and 1(*b*) illustrate a structure and electric field distribution of a dielectric resonator according to the present invention. This dielectric resonator particularly employs the $TE_{011}$ mode in which the electric field travels along a circumferential direction.

Figure 18A:
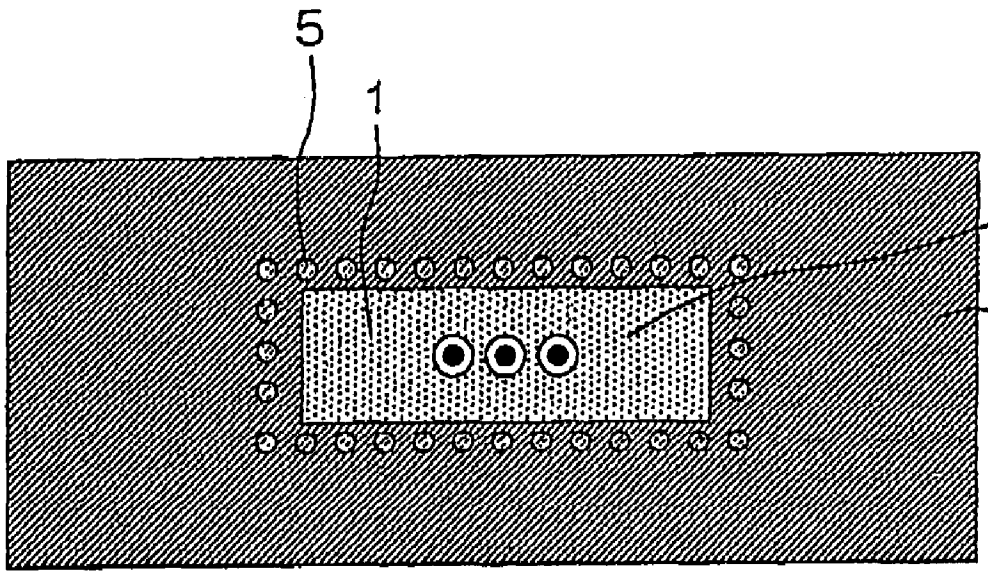
FIG. 18(a) (PRIOR ART)
FIG. 18(*a*) is a cross-sectional plan view showing the structure of a conventional $TE_{10}$ mode dielectric resonator.
Figure 18B:
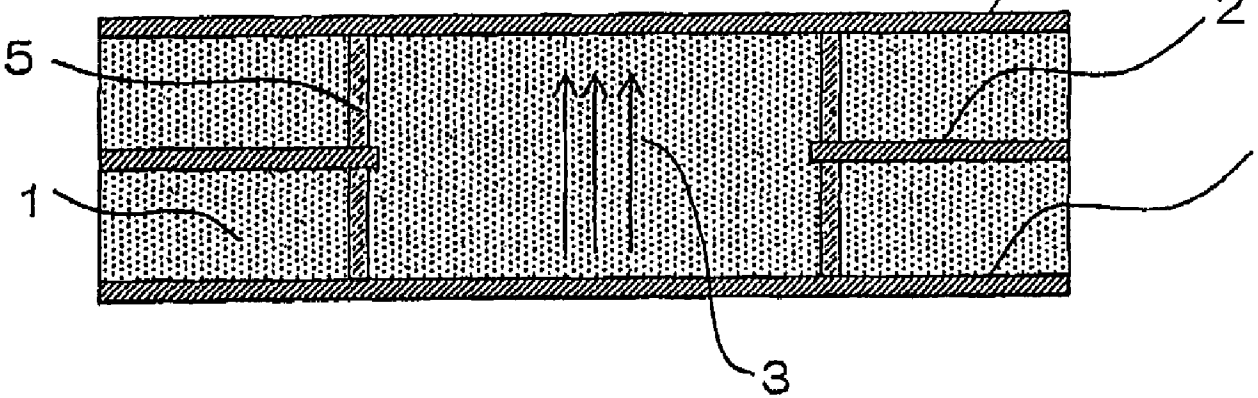
FIG. 18(b) (PRIOR ART)

In the conventional single dielectric resonator using via conductors shown in FIGS. 18(*a*) and 18(*b*), the electromagnetic field radiates unless via conductors are present. In this embodiment, resonance is accomplished as described below.

Referring to FIGS. 1(*a*) and 1(*b*), the dielectric resonator is arranged such that a dielectric substrate 1 including a plurality of stacked dielectric layers is disposed on a lower conductor 4*b* serving as the ground, and an upper conductor 4*a* is disposed on the dielectric substrate 1. An interior metallized layer 2 formed with a resonance aperture area 3 is disposed in a dielectric layer inside the dielectric substrate 1. The resonance aperture area 3 has a circular shape, and the lower conductor 4*b* and the upper conductor 4*a* and interior metallized layer 2 are arranged in parallel with one another.

As the foregoing dielectric substrate 1, for example, the following is used: an organic dielectric substrate including glass epoxy resin or the like that is formed with an interior metallized layer 2 using a conductor such as copper foil, or an inorganic dielectric substrate 1 made of a ceramic material including an interior metallized layer 2 disposed therein that is fired together with the dielectric substrate 1.

As the foregoing interior metallized layer 2, for example, the following is used: a layer comprising a wiring conductor layer made of a conductor using copper foil, which is formed in an organic dielectric layer 1 including glass epoxy resin or the like, or a layer comprising various wiring conductor layers that is formed in an inorganic dielectric layer made of a ceramic material or the like, which is fired together with the dielectric substrate.

A ceramic material with a relatively high relative dielectric constants $\epsilon$ of between 4-25 is preferably used for the dielectric substrate 1, because sufficient capacitance can be obtained even if the area is small by increasing the dielectric constant so that the strip line length can be shortened, contributing to downsizing of the overall configuration. In addition, since generally, using ceramic substrates leads to lower dielectric loss as compared to using resin substrates, it is effective to improve the Q factor of the dielectric resonator.

As the foregoing ceramic material, at least one kind selected from the group consisting of: (1) a ceramic material with a firing temperature of 1100° C. or more composed mainly of $Al_2O_3$, AlN, $Si_3N_4$, or SiC; (2) a low-firing-temperature ceramic material comprising a mixture of metal oxides that can be fired at a temperature of 1100° C. or below, in particular, 1050° C. or below; (3) a low-firing-temperature ceramic material comprising a glass powder, or a mixture of glass powder and ceramic filler powder that can be fired at a temperature of 1100° C. or below.

As the foregoing mixture mentioned in (2), a ceramic material such as BaO—$TiO_2$ based material, Ca—$TiO_2$ based material, MgO—$TiO_2$ based material or the like to which an appropriate agent selected from among $SiO_2$, $BiO_3$, CuO, $Li_2O$, $B_2O_3$ or the like is added is used.

As the glass component mentioned in (3), a glass component comprising at least $SiO_2$ and at least one kind selected from the group consisting of $Al_2O_3$, $B_2O_3$, ZnO, PbO, an alkaline-earth metal oxide and an alkaline metal oxide is used. Specifically, $SiO_2$—$B_2O_3$—RO based, $SiO_2$—Ba O—$Al_2O_3$—RO based, $SiO_2$—$B_2O_3$—$Al_2O_3$—RO based, and $SiO_2$—$Al_2O_3$—RO based compositions, and compositions including the foregoing materials mixed with ZnO, PbO, Pb, $ZrO_2$, $TiO_2$ or the like may be recited. For the glass, glasses that stay amorphous even after firing, and glass ceramics from which crystals of at least one kind selected from the group consisting of alkaline metal silicate, quartz, cristobalite, cordierite, mullite, enstatite, anorthite, celsian, spinel, gahnite, diopside, ilumenite, willemite, dolomite, petalite, and substituted derivatives thereof are precipitated by firing may be recited.

As the ceramic filler mentioned in (3) above, a ceramic filler comprising at least one kind selected from the group consisting of $Al_2O_3$, $SiO_2$ (quartz, cristobalite), forsterite, cordierite, mullite, $ZrO_2$, enstatite, spinel, magnesia, AlN, $Si_3N_4$, SiC, and titanates including $MgTiO_3$ and $CaTiO_3$ may be recited. It is preferable that 20-80% by mass of the glass be mixed with 20-80% by mass of the filler.

Meanwhile, various combinations are possible for the interior metallized layer 2 depending on the firing temperature of the ceramic material constituting the dielectric substrate, because it is formed by firing together with the dielectric substrate 1. For example, when the ceramic material is the foregoing case (1), a conductor material mainly comprising at least one kind selected from the group consisting of tungsten, molybdenum, manganese, and copper is suitably used. Or, for the purpose of reducing the resistance, it may be a mixture including copper and the like. When the ceramic material is a low-firing-temperature ceramic material as in the foregoing cases (2) and (3), a low resistance conductor material mainly comprising at least one kind selected from the group consisting of copper, silver, gold and aluminum may be used.

It is preferable that the interior metallized layer 2 be formed with the use of the foregoing low-firing-temperature ceramic material mentioned in (1) and (2) because it enables the use of a low resistance conductor for forming the interior metallized layer 2.

A specific method for producing the multilayer substrate is now described. A ceramic green sheet is formed using alumina, mullite, forsterite, aluminum nitride, silicon nitride, or glass as the base material, and a known sintering agent and a compound such as titanate that contributes to improving the dielectric coefficient mixed therewith.

A conductor layer serving as the interior metallized layer 2 is formed on the surface of one ceramic green sheet. In order to form the conductor layer, conductor paste comprising the aforesaid metal is applied to the surface of the ceramic green sheet or a metal foil comprising the foregoing metal is attached thereto. At the portions for forming via holes, the ceramic green sheet is provided with through-holes and inner walls of the through-holes are applied with conductor paste, or the entire through-holes are filled with the conductor paste.

The foregoing ceramic green sheets are stacked, which are thermally welded under a required pressure and at a required temperature, and then fired.

Let the diameter of the resonance aperture area 3 be expressed as Ds, the thickness of the dielectric layer between the interior metallized layer 2 and the upper conductor 4*a* be expressed as h1, and the thickness of the dielectric layer between the interior inetallized layer 2 and the lower conductor 4*b* be expressed as h2. Suppose any of the thicknesses h1 and h2 which is larger is h.

The thickness h of the dielectric layer and the relative dielectric constant $\epsilon$ of the dielectric are determined to be a value at which the millimeter wave frequency signals at the resonant frequency is attenuated. More specifically, the dielectric substrate 1 has the structure of parallel plates, where it is sandwiched between the interior metallized layer 2 and upper conductor 4*a*, and between the interior metallized layer 2 and lower conductor 4*b*. In order to prevent millimeter waves from radiating out of the ends of the parallel plates, it is necessary to design by setting a condition in which millimeter waves do not propagate between the parallel plates, that is, in a frequency range not exceeding cutoff frequency fc. Since frequency f used at millimeter wave bands is high and wavelength thereof is short, it is feared that the cutoff frequency fc is lower than frequency f for use, i.e., millimeter waves propagate in specimens having dielectric layers with great h and high relative dielectric constant $\epsilon$. The cutoff frequency fc of parallel plates is expressed as the following equation:

$$fc=\frac{1}{2h\sqrt{(\mu\epsilon)}}$$

where $\mu$ is relative permittivity of the dielectric Accordingly, the values of thickness h and relative dielectric constant $\epsilon$ of the dielectric layer need to be selected so that the cutoff frequency fc is higher than the frequency f for use. That is, $$fc>f$$

needs to be satisfied.

Since this dielectric resonator uses $TE_{011}$ mode, the electric field is zero at the surfaces of the upper conductor 4*a* and lower conductor 4*b* and increases as the location nears the center of the dielectric substrate. For this reason, the electric field can be effectively enclosed by the resonance aperture area 3 of the interior metallized layer 2, so that a resonator with high Q factor can be constructed.

Figure 2:
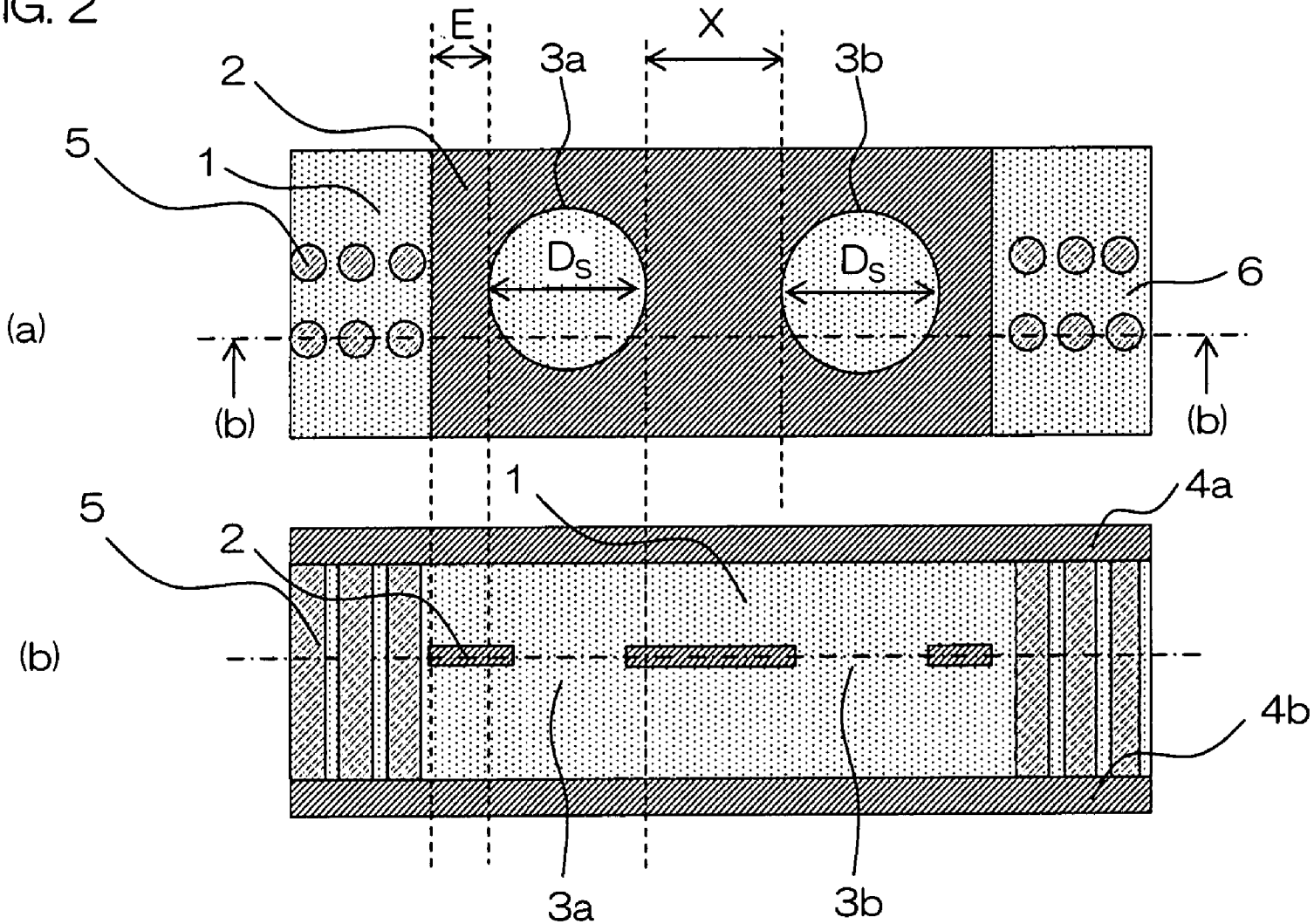
FIG. 2 is a cross-sectional plan view (*a*) and a vertical cross-sectional view (*b*), respectively, of a structural embodiment of a dielectric filter according to the present invention.

FIG. 2(*a*) is a cross-sectional plan view showing one structural embodiment of a dielectric filter according to the present invention. FIG. 2(*b*) shows a vertical cross section of the dielectric filter according to the present invention.

In FIGS. 2(*a*) and 2(*b*), the dielectric filter has a structure arranged such that a dielectric substrate 1 is disposed on a lower conductor 4*b* serving as the ground, an interior metallized layer 2 formed with resonant aperture areas 3*a*, 3*b* is disposed in the dielectric substrate 1, and an upper conductor 4*a* is disposed on the upper surface of the dielectric substrate 1. By controlling the distance x between the resonance aperture areas 3*a* and 3*b*, the coupling coefficient between the dielectric resonators is determined.

Via conductors 5 connecting the upper conductor 4*a* to the lower conductor 4*b* are arranged in two lines with a predetermined pitch to constitute a multilayer-type waveguide 6. End portions of the multilayer-type waveguide 6 are opposed to the resonance aperture areas 3*a* and 3*b*, respectively, with a distance E in between. Signals are inputted and outputted in the dielectric filter by the multilayer-type waveguide 6.

By setting the difference between resonant frequencies of the two dielectric resonators at a predetermined value in the structure above, it is possible to compose a dielectric filter having the function of a band-pass filter, band-stop filter or the like. In addition, it is also possible to create an attenuation pole outside the band.

Figure 3:
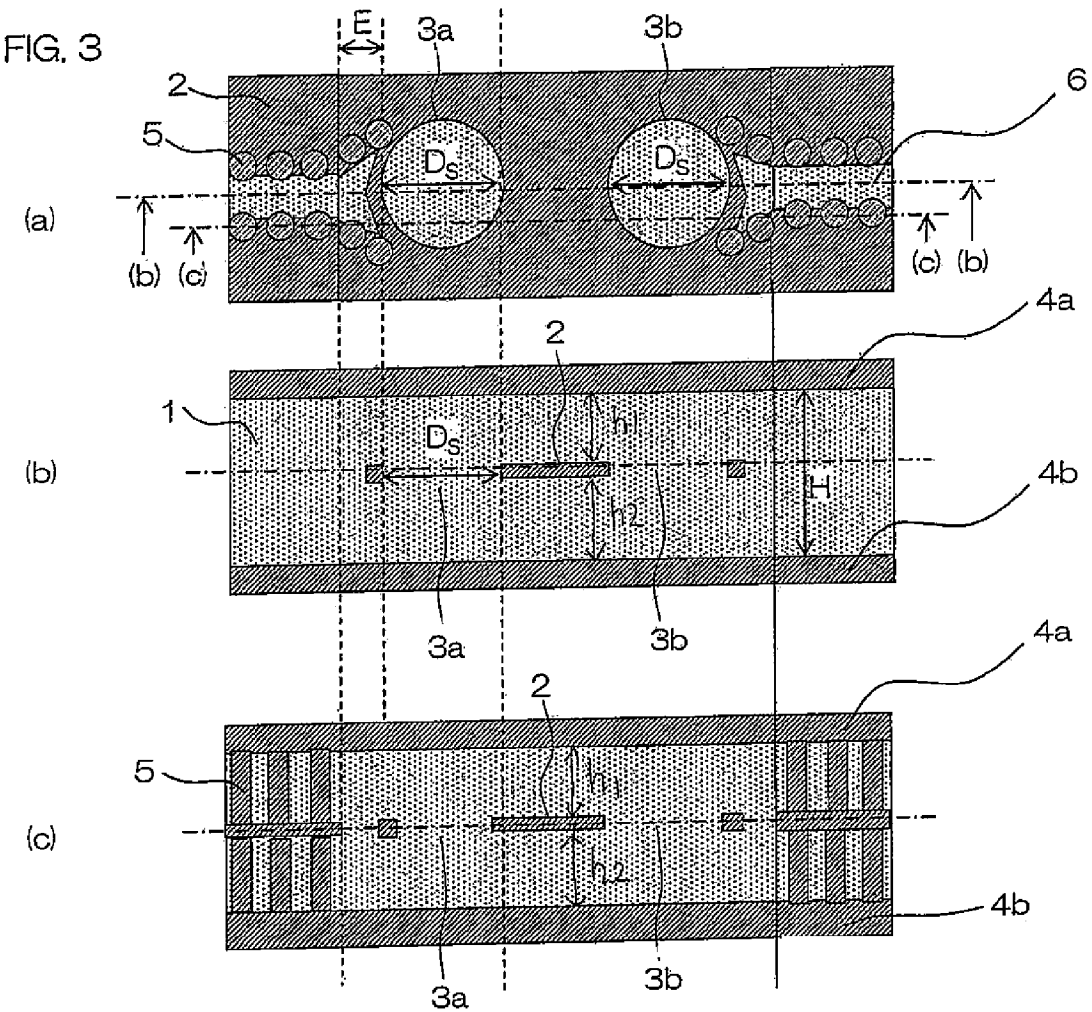
FIG. 3 is a cross-sectional plan view (*a*), a vertical cross-sectional view (*b*), and a vertical cross-sectional view (*c*), respectively, of another structural embodiment of a dielectric filter according to the present invention.

FIG. 3 is a cross-sectional plan view (*a*), a vertical cross-sectional view (*b*), and a vertical cross-sectional view (*c*), respectively, of another structural embodiment of a dielectric filter according to the present invention.

Figure 4:
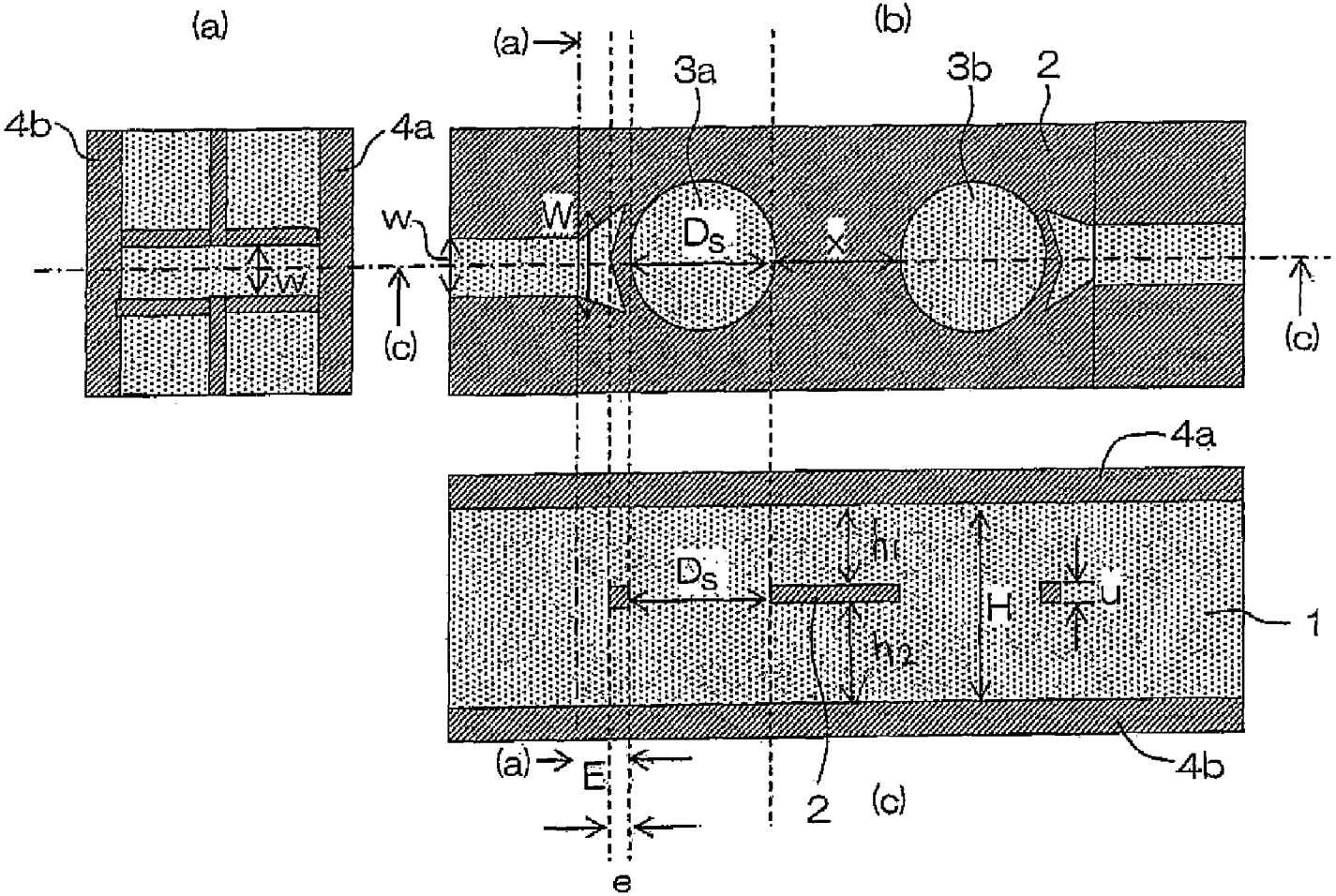
FIG. 4 shows an example of dimensions of the dielectric filter in FIG. 3, in which (*a*) is a cross-sectional side view, (*b*) is a cross-sectional plan view, and (*c*) is a vertical cross-sectional view.

FIG. 4 shows dimensions of individual sections of the dielectric filter in FIG. 3, in which (*a*) is a cross-sectional side view, (*b*) is a cross-sectional plan view, and (*c*) is a vertical cross-sectional view.

In FIG. 3 and FIG. 4, the structure that includes a dielectric substrate 1, an upper conductor and a lower conductor 4*a*, 4*b* disposed on and under the dielectric substrate 1, respectively, and an interior metallized layer 2 having a plurality of resonance aperture areas 3*a*, 3*b* spaced apart from each other by a predetermined distance is the same as that shown in FIGS. 2(*a*), 2(*b*).

In the structures of FIGS. 3 and 4 in order to obtain a desired strong coupling, open end portions of multilayer-type waveguide 6 formed by via conductors 5 are expanded in the vicinity of resonance aperture areas 3*a*, 3*b*.

In other words, in the structures of FIGS. 3 and 4, distance w between the two lines of via conductors 5 is increased over a certain length E in a funnel-like manner as the location nears the resonant aperture area 3*a*. By this arrangement, the electric field distribution is expanded in a lateral direction (in the direction perpendicular to the signal propagation direction) so that strong electromagnetic coupling with the resonance aperture area 3*a* is obtained.

Incidentally, an interior metallized layer 2 is present over a distance of e between the end portion of the multilayer-type waveguide 6 and the resonance aperture area 3*a*. This is intended to make the resonance aperture area 3*a* an enclosed space in plan view so that the Q factor of the resonance is not decreased.

Figure 5:
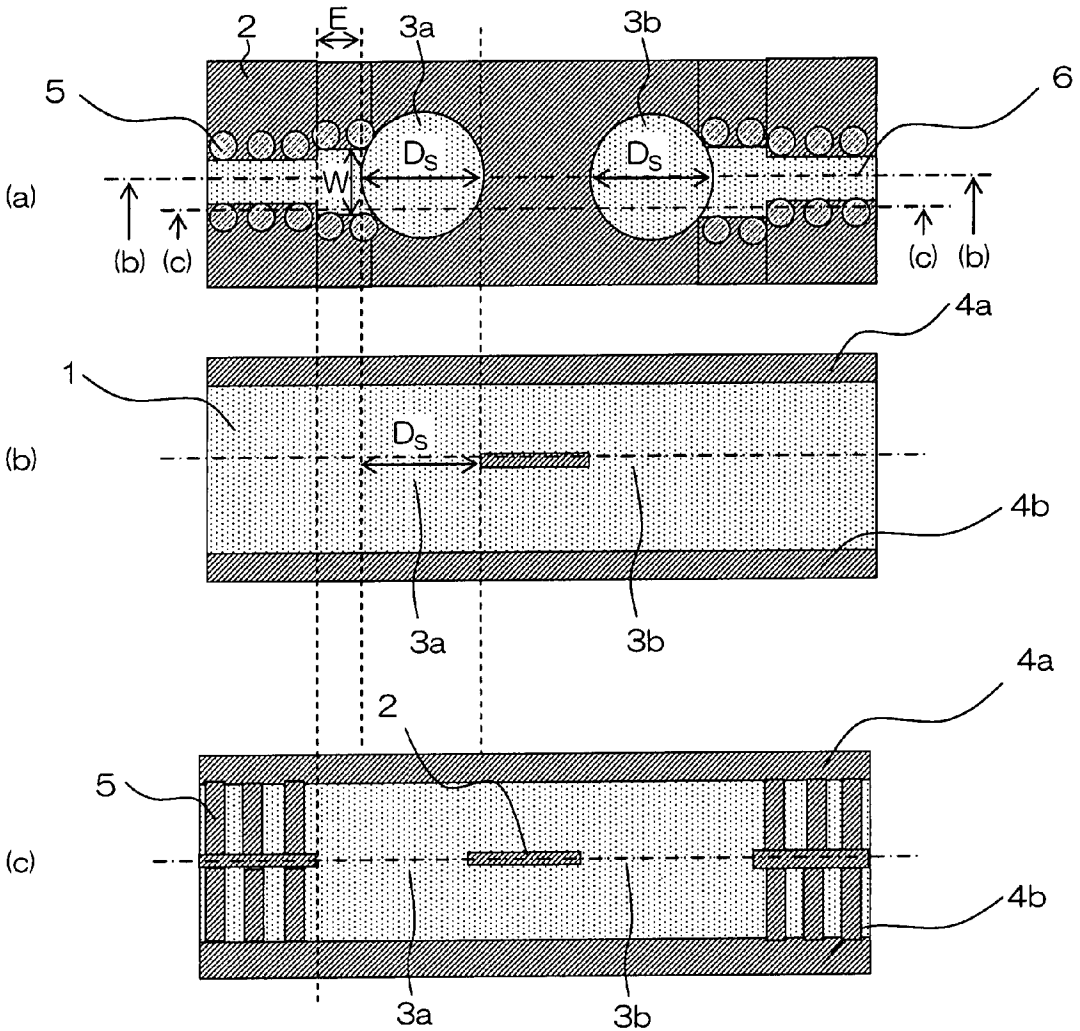
FIG. 5 is a cross-sectional plan view (*a*), a vertical cross-sectional view (*b*), and a vertical cross-sectional view (*c*), respectively, of still another structural embodiment of a dielectric filter according to the present invention.

FIG. 5 is a cross-sectional plan view (*a*), a vertical cross-sectional view (*b*) and a vertical cross-sectional view (*c*), respectively, of still another structural embodiment of a dielectric filter according to the present invention.

Also the structures in FIG. 5 are arranged in the same way as those in FIGS. 3 and 4 such that open end portions of an interior waveguide 6 formed by via conductors 5 are expanded in the vicinity of resonance aperture areas 3*a* and 3*b* so as to obtain a desired strong coupling with input/output waveguide sections.

However, while in the structures of FIGS. 3 and 4, distance w between two lines of via conductors 5 is expanded as the location nears the resonance aperture area 3*a* in a funnel-like manner, in the structure shown in FIG. 5, the distance w between two lines of via conductors 5 of multilayer-type waveguide 6 starts increasing in a stepped manner over a distance E from a location anterior to the resonance aperture area 3*a* so that w becomes W. By this arrangement, the electric field distribution is expanded in a lateral direction (in the direction perpendicular to the signal propagation direction) so that strong electromagnetic coupling with the resonance aperture area 3*a* is obtained.

Meanwhile, in the structure of FIG. 5, an open end portion of the multilayer-type waveguide 6 and the resonance aperture area 3*a* are directly communicated with each other without leaving the internal metallized layer 2 in between. By controlling the distance W and length E, the amount of coupling can be controlled. Although this slightly reduces the Q factor of resonance, electromagnetic coupling stronger than those of FIGS. 3 and 4 can be attained.

Figure 9:
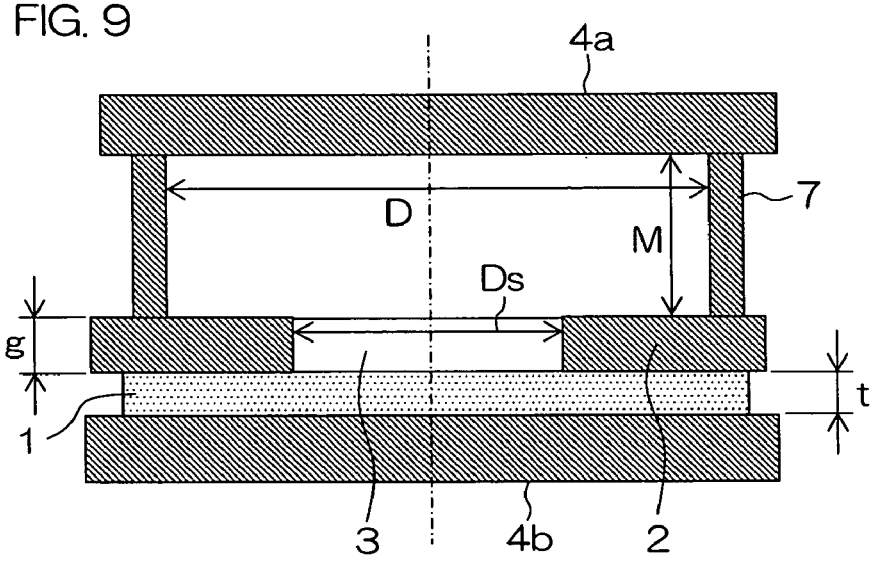
FIG. 9 is a vertical cross-sectional view of an embodiment of a dielectric resonator according to the present invention.

FIG. 9 shows a vertical cross section of another embodiment of a dielectric resonator according to the present invention. In FIG. 9, the dielectric resonator is arranged such that a dielectric substrate 1 is disposed on a lower conductor 4*b* serving as the ground, a conductor 2 formed with a resonance aperture area 3 is disposed on the dielectric substrate 1, and a conductor 4*a* is disposed above the conductor 2, which are spaced apart from each other by a distance of M. The lower conductor 4*b*, conductor 2 and conductor 4*a* are of circular shape, and arranged in parallel with one another.

For the dielectric substrate 1, for example, an organic dielectric substrate made from glass epoxy resin or the like, or an inorganic dielectric substrate made from a ceramic material is used.

In particular, using a ceramic material is effective for miniaturization of the device, because generally, relative dielectric constants of ceramic dielectrics are between 5-25, which are higher than those of resin substrates and allow the thickness of the dielectric layer to be small. In addition, since generally, using a ceramic material for the dielectric substrate yields lower dielectric loss than when a resin substrate is used, it is effective for improving the Q factor of the filter.

Materials for the foregoing conductors may be gold, silver, copper and the like.

A cylindrical member 7 for supporting the conductor 4*a* is connected to the conductor 2. The cylindrical member 7 also comprises a conductor. The diameter of the resonance aperture area 3 is represented by Ds, and the diameter of a space formed by the conductors 2 and 4*a* is represented by D. The thickness of the dielectric substrate 1 is represented by t, and the thickness of the resonance aperture area 3 is represented by g. The thickness t of the dielectric layer and its relative dielectric constant $\epsilon$ are determined to be values at which millimeter wave frequency signals at a resonant frequency are attenuated. More specifically, the dielectric substrate 1 has the structure of parallel plates, where it is sandwiched between the conductor 4*b* and the conductor 2. In order to prevent millimeter waves from radiating out of the ends of the parallel plates, it is necessary to design by setting a condition that millimeter waves do not propagate between the parallel plates, that is, they are in a frequency range not exceeding cutoff frequency fc. Although too much consideration is not necessary for the conventional microwave bands, since frequency f used at millimeter wave bands is high and wavelength thereof is short, it is feared that cutoff frequency fc is lower than the frequency f for use, i.e., millimeter waves propagate in specimens having dielectric layers with great thickness t and high relative dielectric constant $\epsilon$. The cutoff frequency fc of the parallel plates is expressed as the following equation:

$$fc=\tfrac{1}{2}t\sqrt{(\mu\epsilon)}$$

Accordingly, the values of thickness t and relative dielectric constant $\epsilon$ of the dielectric layer need to be selected so that the cutoff frequency fc is higher than the frequency f for use.

The reason that the dielectric resonator according to the present invention is effective for millimeter wave bands is now described.

Figure 19:
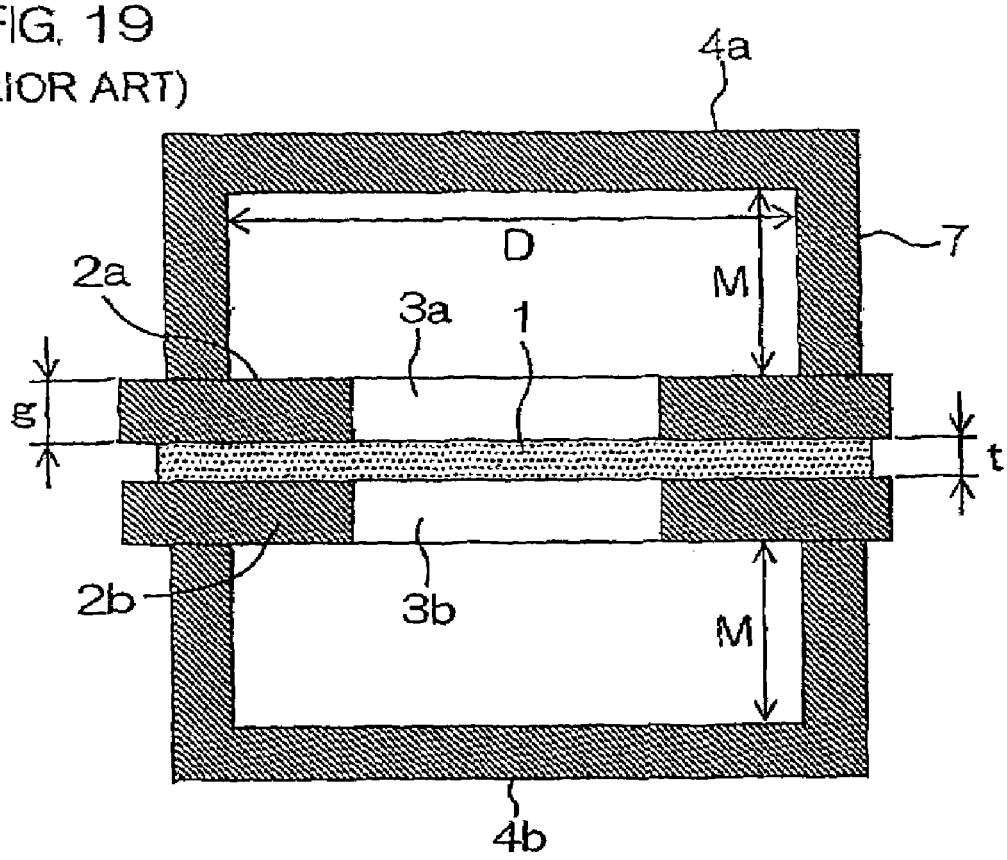
FIG. 19 (PRIOR ART)
FIG. 19 is a vertical cross-sectional view showing the structure of a conventional dielectric resonator having a void.

This dielectric resonator uses $TE_{010}$ mode, in which the electric field is zero at the surface of the lower conductor 4*b*, and then increases. For this reason, the electric field energy of $TE_{010}$ mode stored in the dielectric substrate 1 disposed to be in contact with the lower conductor 4*b* is smaller than the electric field energy stored in the dielectric substrate 1 of the conventional $TE_{010}$ mode dielectric resonator shown in FIG. 19.

Figure 10:
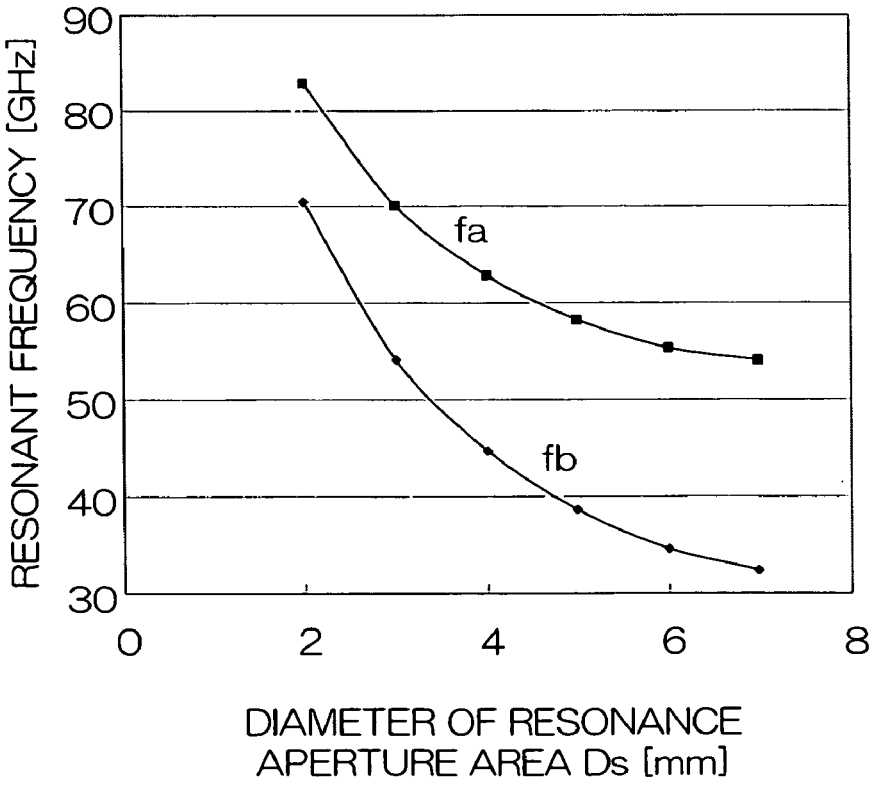
FIG. 10 is a graph showing a result of calculations of resonant frequency with respect to diameter of resonance aperture area comparing a dielectric resonator according to the present invention with a conventional $TE_{010}$ mode dielectric resonator.

FIG. 10 shows a result of calculations of resonant frequencies of the dielectric resonator according to the present invention and the conventional $TE_{010}$ mode dielectric resonator. The horizontal axis of the graph represents diameter Ds of the resonance aperture area 3 and the vertical axis represents resonant frequency. The calculations were performed assuming that the space is filled with air, diameter of the space D=6.98 mm, height of the space M=1.95 mm, thickness of the resonance aperture area g=0.15 mm, thickness of the dielectric substrate 1 t=0.5 mm, and relative dielectric constant of the dielectric=10. The symbol fa denotes resonant frequency of the dielectric resonator of the present invention and the symbol fb denotes resonant frequency of the dielectric resonator of the conventional dielectric resonator. The result shows that the dielectric resonator of the present invention has higher resonant frequency when the conditions are equal. In addition, the curve of resonant frequency fa is milder than the curve of resonant frequency fb.

This indicates that when the conditions (including relative dielectric constant, thickness of the dielectric, height of upper conductor M, diameter Ds of resonance aperture area 3) are equal, the dielectric resonator of the present invention can be designed for resonant frequencies higher than those for the conventional $TE_{010}$ mode dielectric resonator, and therefore more suitable for dielectric resonators for millimeter wave bands. For the same frequency, the size Ds of resonance aperture area can be designed to be larger than that of the conventional $TE_{010}$ mode dielectric resonator by the present invention. Moreover, since the curve of resonant frequency fa is milder than that of resonant frequency fb, requirements for machining accuracy in the production can be more lenient in the present invention.

Figure 11:
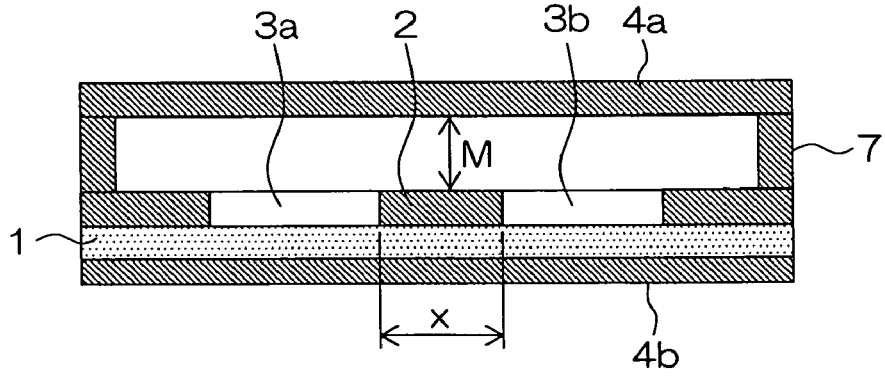
FIG. 11(*a*) is a vertical cross-sectional view of a structural embodiment of a dielectric filter according to the present invention.
Figure 11:
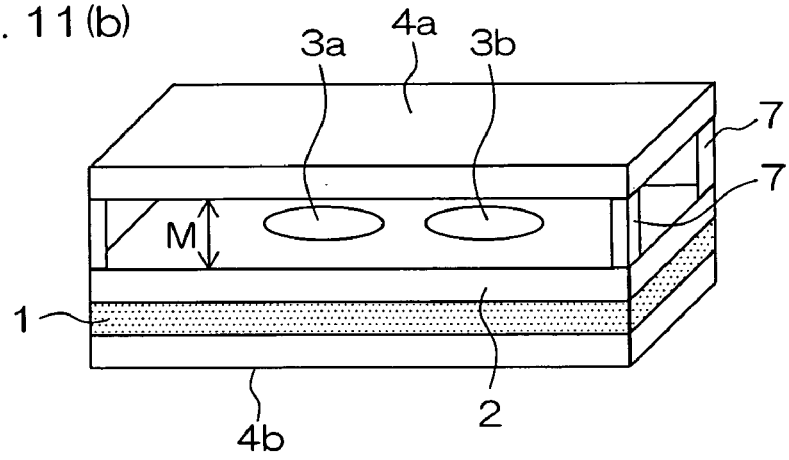

FIG. 11(*a*) is a vertical cross-sectional view showing one structural embodiment of a dielectric filter according to the present invention. FIG. 11(*b*) shows a perspective view of the dielectric filter according to the present invention.

In FIGS. 11(*a*) and 11(*b*), the dielectric filter is arranged such that a dielectric filter 1 is disposed on a lower conductor 4*b* serving as the ground, a conductor 2 formed with resonance aperture areas 3*a* and 3*b* is disposed on the dielectric substrate 1, and a conductor 4*a* is disposed above the conductor 2 being spaced apart therefrom by a distance of M. The lower conductor 4*b*, conductor 2, and conductor 4*a* are of rectangular shape, and arranged in parallel with one another.

The conductor 2 is provided with support members 7 for supporting the conductor 4*a*, the support members 7 may be a conductor or dielectric. When the support members 7 is a dielectric, the height M thereof is determined to be a height at which electromagnetic waves do not propagate in a lateral direction between the upper and lower conductors, that is, a height at which the propagation mode is in a cutoff range.

The resonance aperture area 3*a* and resonance area 3*b* are arranged being spaced apart from each other by a distance of x so that a desired coupling coefficient between resonators can be obtained.

When this dielectric filter is applied to millimeter wave band applications, it needs to be arranged so that the dielectric resonators have the same resonant frequency, as the result in FIG. 10 shows, when the variation of resonance aperture area with respect to the design value Ds is ±1 μm, the variation of resonant frequency of the conventional $TE_{010}$ mode dielectric resonator is ±16 MHz as compared with ±4 MHz of the dielectric resonator of the present invention. This indicates that with the dimensional accuracy being the same, the accuracy in resonant frequency is improved in the present invention from the conventional case. Accordingly, dielectric filters having uniform characteristics can be produced with good yield.

Figure 12:
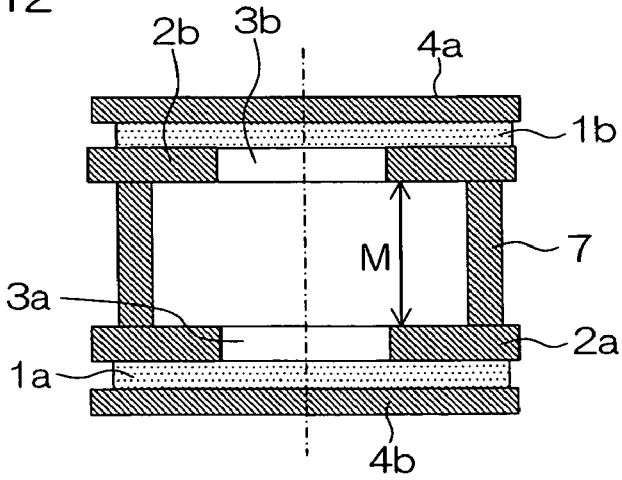
FIG. 12 is a vertical cross-sectional view of another structural embodiment of a dielectric filter according to the present invention.

FIG. 12 shows a vertical cross section of another structural embodiment of the dielectric filter according to the present invention.

In FIG. 12, a dielectric substrate 1*a* is disposed on a lower conductor 4*a*, and a conductor 2 formed with a resonance aperture area 3*a* is disposed on the dielectric substrate 1*a*. In addition, a dielectric substrate 1*b* is disposed under an upper conductor 5*c*, and a conductor 2*b* formed with a resonance aperture area 3*b* is disposed under the dielectric substrate lb. The conductors 2*a* and 2*b* are supported by support members 7. The support members 7 may be conductors or dielectrics. When they are dielectrics, since dielectric itself has no cutoff effect, the height M of the support members 7 is determined to be a height at which electromagnetic waves do not propagate in a lateral direction between the upper and lower conductors at the frequency for use, that is, a height at which the propagation mode is in a cutoff range.

The two resonance aperture areas 3*a* and 3*b* are arranged to be opposed to each other at least in a part.

The dielectric filter in FIG. 12 has a structure utilizing the coupling of dielectric resonators arranged vertically, which allows the width of the dielectric filter to be smaller than in the structure of FIGS. 11(*a*) and 11(*b*). In addition, unlike the conventional structure in FIG. 19, the two resonance aperture areas 3*a* and 3*b* do not need to perfectly overlap each other and a miner difference in size is permitted. Also from this point of view, the structure of FIG. 12 is advantageous.

Figure 13:
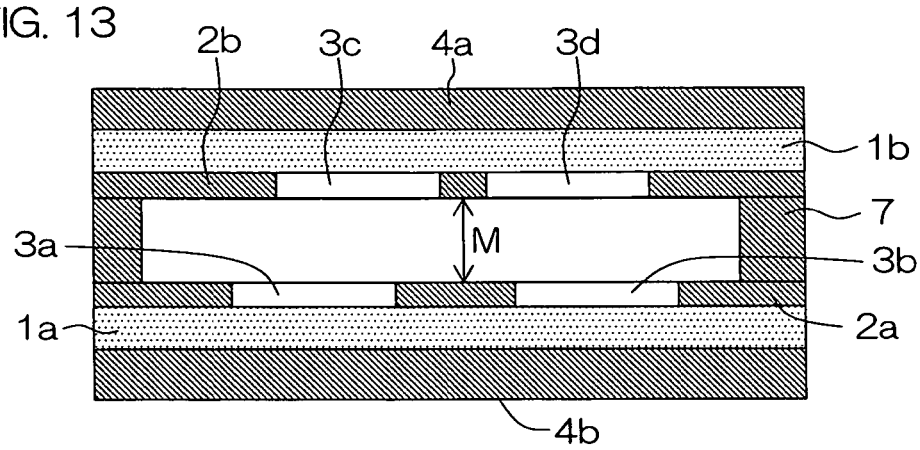
FIG. 13 is a vertical cross-sectional view of still another structural embodiment of a dielectric filter according to the present invention.

FIG. 13 shows a vertical cross section of another structural embodiment of a dielectric filter according to the present invention. This structure combines the dielectric filter in FIGS. 11(*a*) and 11(*b*) with the dielectric filter in FIG. 12 and arranged such that a dielectric substrate 1*a* is disposed on a lower conductor 4*b*, and a conductor 2*a* formed with resonance apertures 3*a* and 3*b* is disposed on the dielectric substrate 1*a*. In addition, a dielectric substrate 1*b* is disposed under an upper conductor 5*c*, and the dielectric substrate 1*b* is disposed under a conductor 2*b* formed with resonance aperture areas 3*c* and 3*d*. Peripheral areas of the conductors 4*a* and 4*b* are supported by support members 7, by which a resonance space is formed. The support members 7 may be conductors or dielectrics. When they are dielectrics, since dielectric itself has no cutoff effect, the height M of the support members 7 is determined to be a height at which electromagnetic waves do not propagate in a lateral direction between the upper and lower conductors at the frequency for use, that is, a height at which the propagation mode is in a cutoff range.

The resonance aperture areas of the dielectric filter in FIG. 13 are arranged so that the resonance aperture areas 3*a* and 3*c* are opposed to each other at least in a part, and the resonance aperture areas 3*b* and 3*d* are opposed to each other at least in a part.

Millimeter wave frequency signals are coupled through the resonance aperture area 3*a* to the resonance aperture area 3*c*, coupled through the resonance aperture area 3*c* to the resonance aperture area 3*d*, and coupled through the resonance aperture area 3*d* to the resonance aperture area 3*b*. In this manner, the dielectric resonator provides a four-pole filter connection.

Moreover, according to the dielectric filter in FIG. 13, it is also possible to design a filter with steeper transmittance characteristics by providing cross-coupling from the resonance aperture area 3*c* to the resonance aperture area 3*b* to create a pole outside the band.

While some specific embodiments of the present invention have been described so far, implementation of the present invention is not limited to the foregoing modes. For instance, the number of layers of resonators provided in a dielectric filter is not limited to two, but maybe any number. In addition, the resonance mode is not limited to the $TE_{011}$ mode. Various other modifications may be made without departing from the scope of the present invention.

EXAMPLE 1

First, a single dielectric resonator (FIGS. 1(*a*) and 1(*b*)) for 60 GHz was designed. Analyses of resonant frequency and Q factor were carried out using mode-matching method software for axisymmetric structure and HFSS finite element method software produced by Ansoft corporation.

When conditions were set as diameter of resonant area Ds=3.05 mm, thickness of interior metallized layer 2=0.01 mm, thickness of dielectric substrate h=1.81 mm, the result obtained by the mode-matching method was: resonant frequency f0=60 GHz, and the result obtained by HFSS was: F0=60.3 GHz. The result of HFSS analysis reflected the approximation of circles to dotriacontagons. When conductivity of electrode and conductor was $5.8\times10^{6}$ S/m, and dielectric loss tangent of dielectric was tan $\delta=1\times10^{-3}$, the Q factor of the single dielectric resonator obtained by the mode-matching method was Q=840, and that by HFSS was Q=750.

Using the dimensions of the single dielectric resonator, a 2-pole Tchebycheff band-pass dielectric filter with a center frequency of 60.3 GHz, bandwidth of 600 MHz shown in FIG. 4 was designed by HFSS.

Although in reality, a multilayer-type waveguide is formed using via conductors, due to mesh and memory concern, the calculations were made assuming the part of the multilayer-type waveguide with via conductors to be a usual waveguide.

Figure 6:
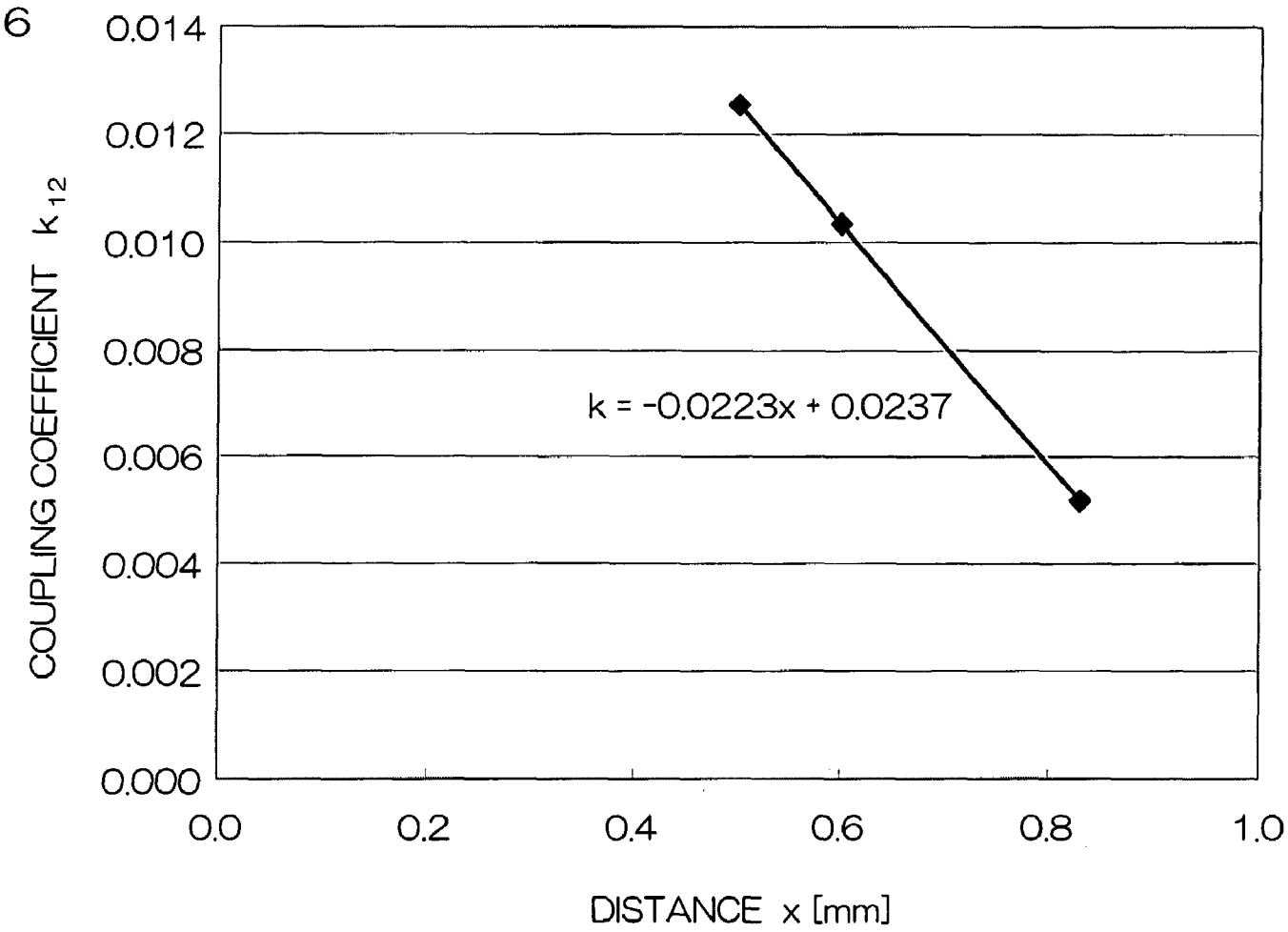
FIG. 6 is a graph showing a variation of coupling coefficient k with respect to distance x between dielectric resonators.

First, a calculation of coupling coefficient $K_{12}$ was performed. The result is shown as a variation of coupling coefficient $K_{12}$ with respect to distance x between the dielectric resonators in FIG. 6. From this result, the necessary coupling coefficient at x=0.55 mm was found to be $K_{12}=0.012$.

Figure 7:
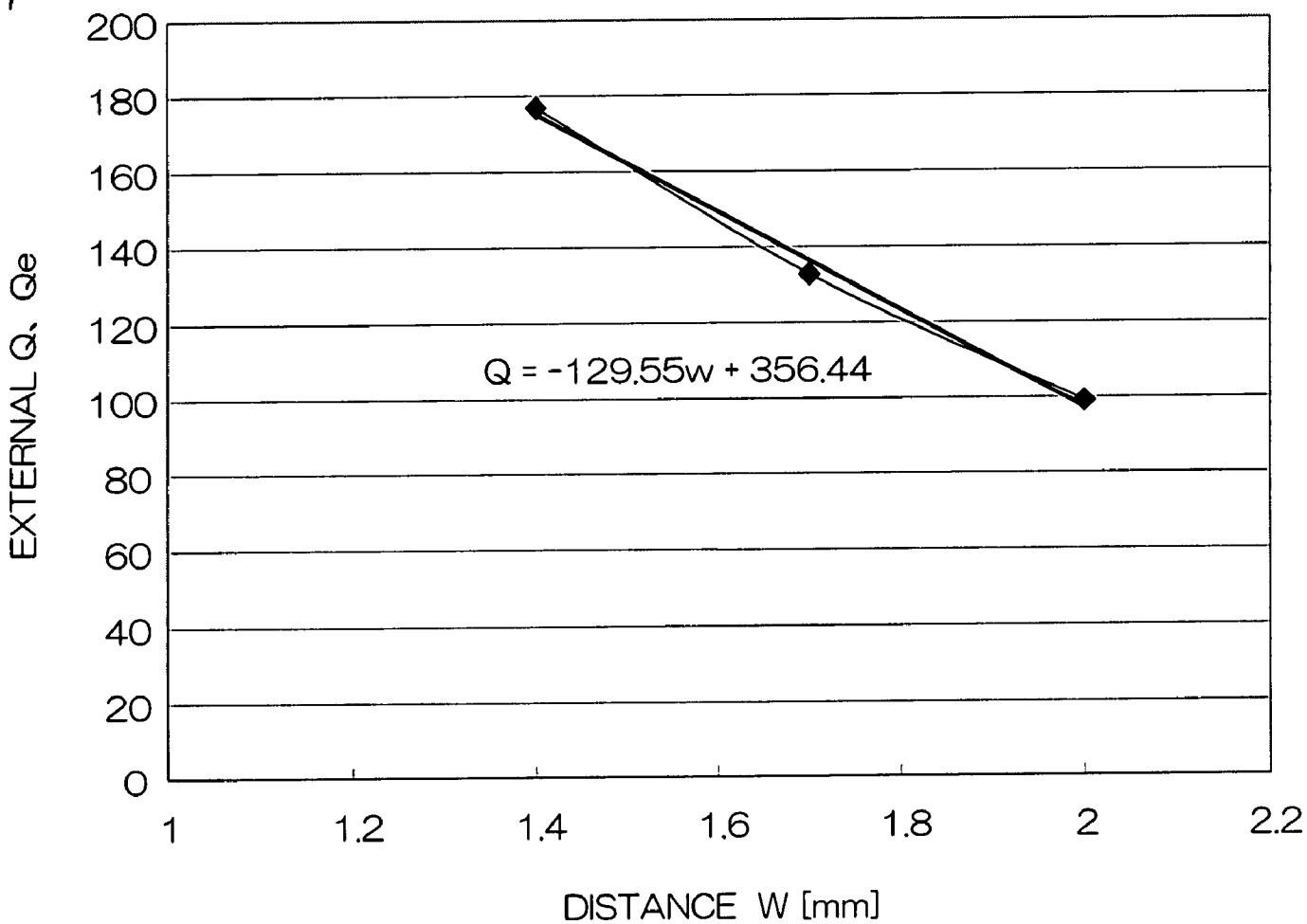
FIG. 7 is a graph showing a variation of Qe with respect to width W of an opening of a multilayer-type waveguide.

Then, calculations of external Q, Qe were performed by HFSS. Signal input/output into the resonator was made by a multilayer-type waveguide w in width and H in thickness. The areas coupling with the resonators were in the shape of a horn antenna as shown in FIG. 4(*a*) with dimensions of e=0.1 mm and E=1.475 mm. The external Q was controlled by the width W. A variation of Qe with respect to W is shown in FIG. 7. FIG. 7 shows that the required Qe=100 was obtained at W=0.2 mm.

From the discussion above, the design values satisfying the specification of the dielectric filter were found as a coupling coefficient between the resonators K12=0.012 and an external Q, Qe=100.

Finally, while checking the matching condition of the dielectric filter, the value of x was finely controlled. As a result, W=2.1 mm was obtained.

Figure 8:
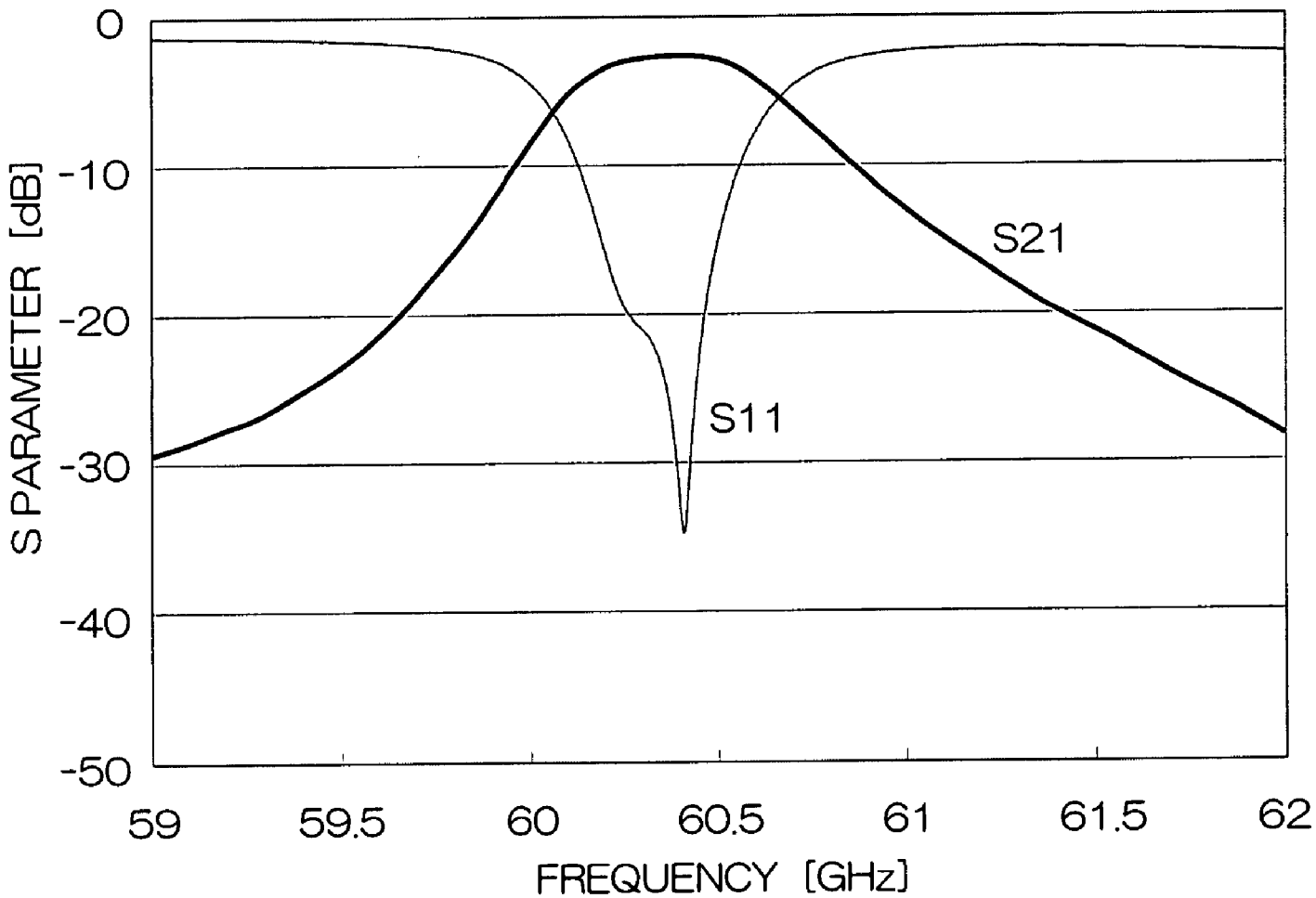
FIG. 8 is a graph showing a result of a simulation of transmission characteristics of a band-pass dielectric filter.

The dimensions obtained in the above described process were inputted and calculations of transmission property, s parameter, of the dielectric filter were performed using HFSS. The result of calculations of the S parameter is shown in FIG. 8. The result verified that the desired property of a band-pass dielectric filter can be obtained, and the practicability thereof was confirmed.

EXAMPLE 2

Figure 14A:
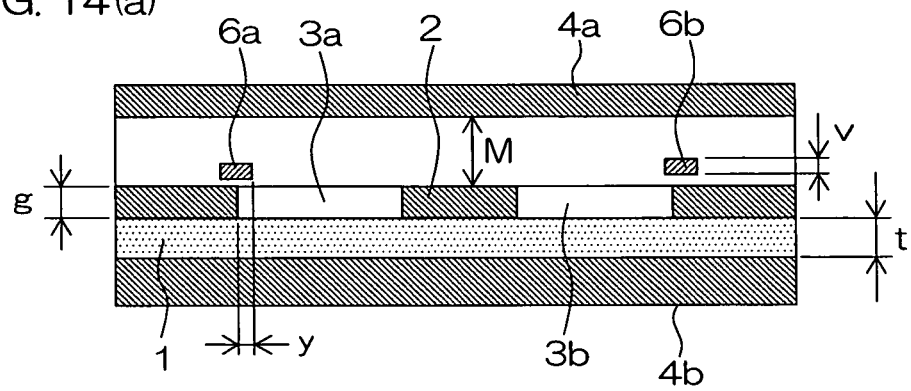
FIG. 14(*a*) is a cross-sectional side view showing the structure of the dielectric band-pass filter according to the present invention that is used in the simulation.
Figure 14B:
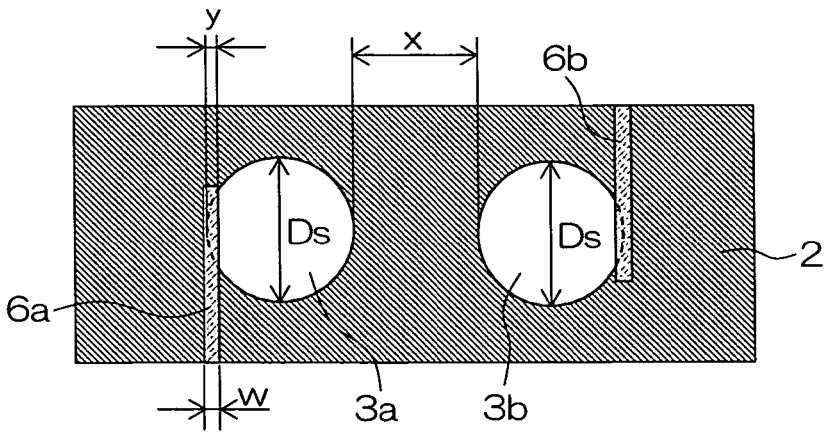

Assuming the dielectric filter with the structure shown in FIGS. 14(*a*), (*b*), a 2-pole maximally flat band-pass filter was designed. For the calculations, HFSS finite element method software produced by Ansoft corporation was used.

Signal input and output were performed from a microstrip line sandwiched by air layers that was designed to have a width of w, thickness of v, and impedance of 50 Ω.

The conditions were set as follows:

diameter of the resonance aperture areas 3*a*, 3*b* Ds=4.54 mm;

height of the resonance space M=1.95 mm;

thickness of the resonance aperture areas g=0.15 mm;

thickness of the dielectric substrate 1 t=0.5 mm;

relative dielectric constant of the dielectric 10;

width of the microstrip line w=0.062 mm;

thickness v=0.1 mm; and conductivity of the electrode and conductor $5.8\times10^6$ S/m.

The Qc of the single dielectric resonator for the conductor loss was measured to be 2600.

The design values satisfying the conditions of a center frequency of 60.4 GHz, a bandwidth of 200 MHz were determined to be a coupling coefficient between the resonators k12=0.00166 and an external Q, Qe of 420.

Figure 15:
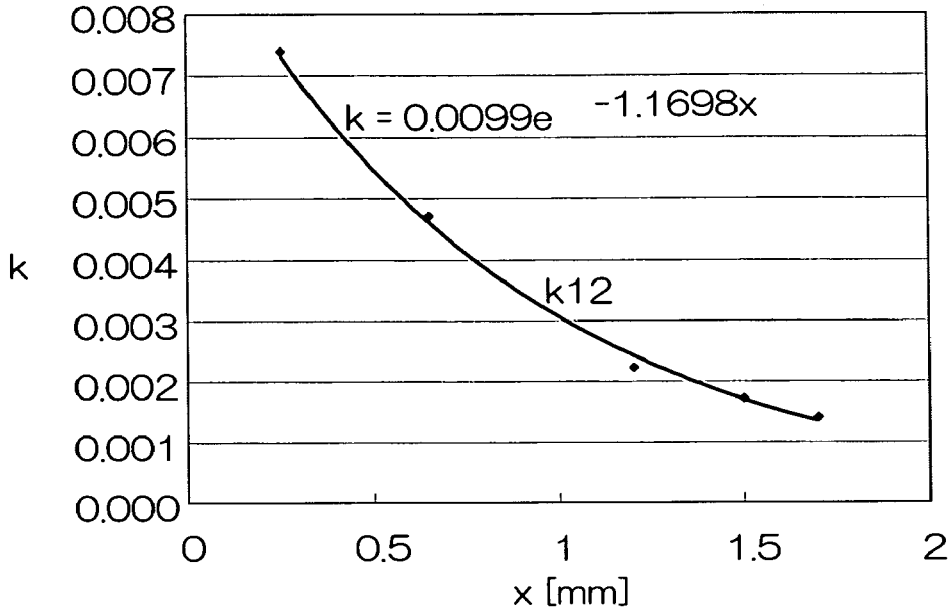
FIG. 15 is a graph showing a variation of coupling coefficient k12 with respect to distance x between dielectric resonators.

First, calculations of coupling coefficient k12 were performed by HFSS. A variation of coupling coefficient k12 with respect to distance x of the dielectric resonator is shown in FIG. 15. From FIG. 15, k12=0.0015 was found to be necessary at x=1.52 mm.

Figure 16:
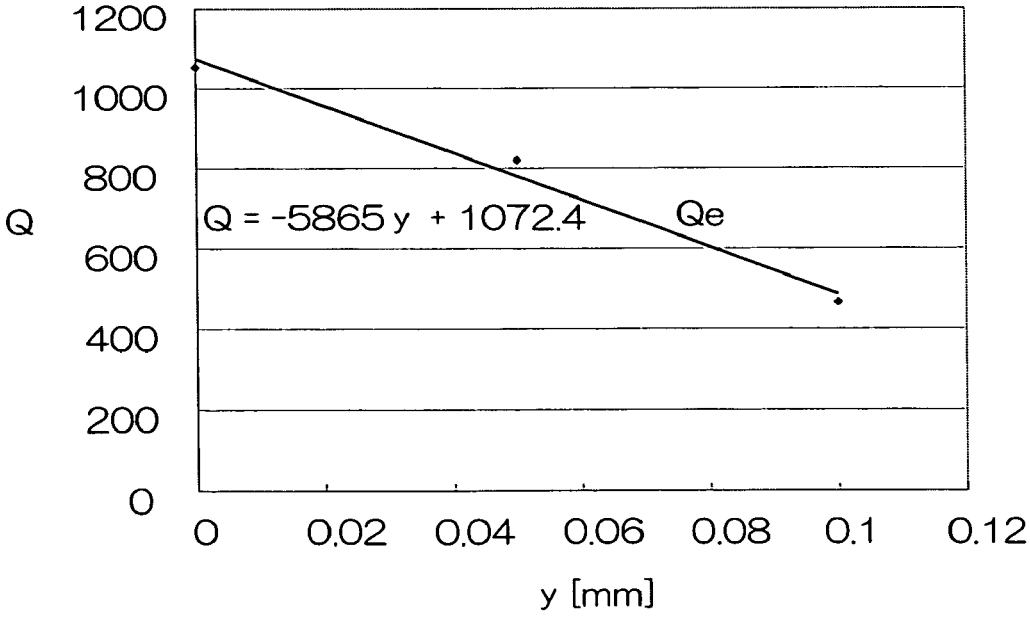
FIG. 16 is a graph showing a variation of Qe with respect to distance y between a part on the circumference of a dielectric resonator and an end of a microstrip line.

Then, calculations of external Qe were performed by HFSS. A variation of Qe with respect to distance y between a part on the circumference of the dielectric resonator and an end of the microstrip line is shown in FIG. 16. From FIG. 16, Qe=420 was found to be necessary at y=0.11 mm.

Finally, the obtained values x, y were applied to the structure shown in FIGS. 14(*a*) and 14(*b*), and reflection parameter S11 and transmission parameter S12 of the filter were calculated using HFSS. The result is shown in FIG. 17.

Figure 17:
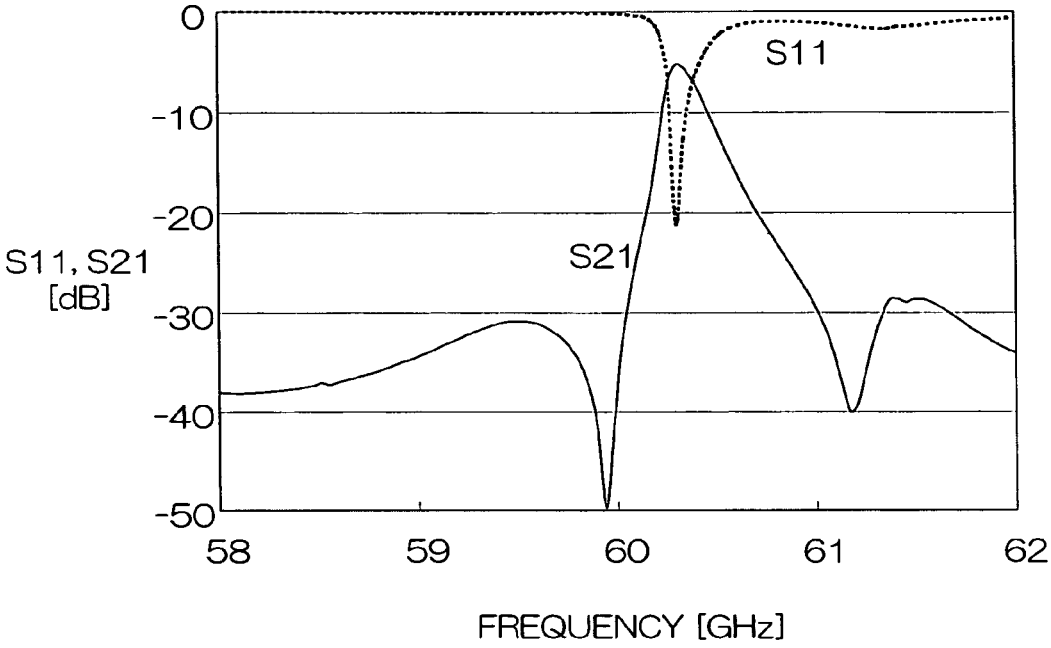
FIG. 17 is a graph showing a result of a simulation of transmission characteristics of the dielectric band-pass filter shown in FIG. 14.

As FIG. 17 shows, a band-pass filter with a center frequency of 60.3 GHz and a bandwidth of 200 MHz is realized. In addition, attenuation poles are formed on both sides of the propagation region.

The disclosures of Japanese Patent Application Serial Nos.2003-383952 and 2004-284151, filed on Nov. 13, 2003 and Sep. 29, 2004, respectively, are incorporated herein by reference.

What is claimed is:

1. A dielectric filter comprising:

a planar-shaped lower conductor and a planar-shaped upper conductor;

a dielectric substrate which includes a plurality of dielectric layers stacked therein and is interposed between the lower conductor and the upper conductor being in contact therewith;

an interior conductor layer having a plurality of resonance aperture areas that is provided in at least one of the dielectric layers inside the dielectric substrate; and a multilayer-type waveguide formed by lines of via conductors arranged inside the dielectric substrate, wherein the resonance aperture areas are juxtaposed with a predetermined distance in between, an open end portion of the multilayer-type waveguide is opposed to one of the plurality of resonance aperture areas provided in the interior conductor layer, and wherein a distance between the lines of via conductors increases to form a funnel or horn shape as the location thereof nears the resonance aperture areas, and one of the dielectric layers has a larger thickness than any of the other dielectric layers, said plurality of dielectric layers disposed;

(1) between the upper conductor and the interior conductor layer, and (2) between the interior conductor layer and the lower conductor;

said dielectric layer of larger thickness having a cutoff frequency fc that is higher than a frequency f used, and at least one or both of signal input and signal output is effected by the multilayer-type waveguide.

2. The dielectric filter according to claim 1, wherein the resonance aperture areas are of circular shape.

3. The dielectric filter according to claim 1, wherein a $TE_{011}$ mode is used as a resonance mode.

4. The dielectric filter according to claim 1, wherein the distance between the lines of via conductors starts to increase in a stepped manner from a location in the vicinity of the resonance aperture areas.

5. The dielectric filter according to claim 4, wherein the resonance aperture areas of the interior conductor layer and open end portions of the multilayer-type waveguide are spaced apart by a predetermined distance by the interior conductor layer.

6. The dielectric filter according to claim 1, wherein the resonance aperture areas of the interior conductor layer and open end portions of the multilayer-type waveguide are directly communicated.

7. The dielectric filter according to claim 1, wherein the filter is formed by simultaneously and integrally firing the plurality of the dielectric layers formed with via holes for forming the lines of via conductors, the lower conductor, the upper conductor, and the interior conductor layer having the plurality of resonance aperture areas.

8. A wireless communication system including the dielectric filter according to claim 1 incorporated thereinto.

9. A dielectric filter according to claim 1, wherein two or more interior conductor layers are provided and the dielectric layer that has a larger thickness than any of the other dielectric layers and also be a layer that exists between a first interior conductor layer and a second consecutive interior conductor layer.

* * * * *